US005403149A

United States Patent [19]

Arnet et al.

[11] Patent Number: 5,403,149

[45] Date of Patent: Apr. 4, 1995

[54] STABAILIZATION DEVICE FOR EXTENDING THE CHARACTERISTIC MAP OF A COMPRESSOR

[75] Inventors: Daniel Arnet, Künten; Klaus Heinrich, Nussbaumen, both of Switzerland

[73] Assignee: Asea Brown Boveri Ltd., Baden, Sweden

[21] Appl. No.: 124,544

[22] Filed: Sep. 22, 1993

[30] Foreign Application Priority Data

Oct. 17, 1992 [EP] European Pat. Off. ..... 92117780

[51] Int. Cl.[6] ..... F04D 29/28; F04D 27/02

[52] U.S. Cl. ..... 415/58.6; 415/914

[58] Field of Search ..... 415/58.2, 58.3, 58.4, 415/58.6, 115, 914; 416/181, 186 R

[56] References Cited

U.S. PATENT DOCUMENTS

| | | | |
|---|---|---|---|
| 2,827,261 | 3/1958 | Parker et al. | 415/206 |
| 4,212,585 | 7/1980 | Swarden et al. . | |
| 4,846,629 | 7/1989 | Takigawa | 416/235 |
| 4,930,978 | 6/1990 | Khanna et al. | 415/58.3 |
| 4,930,979 | 5/1990 | Fisher et al. | 415/58.3 |
| 5,275,531 | 1/1994 | Roberts | 415/914 |
| 5,304,033 | 4/1994 | Tang | 415/914 X |

FOREIGN PATENT DOCUMENTS

| | | |
|---|---|---|
| 1528797 | 6/1968 | France . |
| 675279 | 9/1990 | Switzerland . |
| 761937 | 11/1956 | United Kingdom . |
| 798480 | 7/1958 | United Kingdom . |
| 92/03660 | 3/1992 | WIPO . |

OTHER PUBLICATIONS

"Blower Compressor", Patent Abstracts of Japan, vol. 7, No. 95 (M-209)[1240], Apr. 21, 1983, Jap. Appln. No. 59-18600.

*Primary Examiner*—Edward K. Look
*Assistant Examiner*—Michael S. Lee
*Attorney, Agent, or Firm*—Burns, Doane, Swecker & Mathis

[57] ABSTRACT

In a compressor, the stabilization device for extending the characteristic map consists of a co-rotating ring (2) rigidly connected to the runner blades (1), there being arranged between the ring (2) and the housing (3) of the compressor a recirculation duct (4) which has an opening to the impeller (5) at its rear end in the flow direction, only the previously customary narrow clearance existing subsequently at the rear end of this opening between impeller (5) and wall of the housing. The front edge of the ring (2) in the flow direction can terminate flush with the inlet edges of the runner blades (1), or be axially displaced.

9 Claims, 3 Drawing Sheets

STABAILIZATION DEVICE FOR EXTENDING THE CHARACTERISTIC MAP OF A COMPRESSOR

BACKGROUND OF THE INVENTION

1. Field of the Invention

The invention relates to a stabilization device for extending characteristic map of a compressor 2. Discussion of Background Such stabilization devices are known for axial and radial compressors. In the use of turbo compressors, the aim is to achieve characteristics without hysteresis which fall monotonically with increasing through-flow, in order to achieve a high reliability in the case of operation under part load. Such continuous characteristics are denoted as stable. In the case of part load, however, stable characteristics are the more difficult to achieve the larger the pressure ratio at the design point. Consequently, an attempt is made to produce the desired characteristics by means of additional stabilization devices.

Patent EP 0,229,519 contains a description of a stabilization device for a radial compressor which device is distinguished by the fact that as a sheathing for the impeller the inner housing has radial bores or slots which produce a connection between the incoming-flow duct and the blading and in this case are more or less covered by the blades on the blade side. Although the pumping or stability limit is thereby displaced in the shape of the characteristic, the efficiency of the compressor is simultaneously sharply reduced.

Also known is a centrifugal compressor (U.S. Pat. No. 4,212,585) in which there is present a housing attachment with free recesses which extend in the flow direction. However, particularly in the part-load range these recesses produce a pumping effect, that is to say unstable characteristics. The stabilization device described in the Patent CH 675,279 likewise consists of a recess in the housing of the radial compressor, but in this case there is integrated into this recess a stabilization ring which is arranged upstream of the impeller and outside the main flow and bears on its outer circumference a number of blades which are anchored on the inner contour of the recess. The disadvantage of this solution is the complicated configuration of the housing and of the stabilization device.

It may be stated in summary that the known technical solutions for stabilizing the compressor characteristic map contain a special configuration of the compressor housing. A severe restriction of the compressor reorders possible a recirculation flow through the or in the openings arranged in the compressor housing.

The disadvantage of these known technical solutions is the complicated housing configuration. In addition, in the case of conventional radial impeller designs the runner blades are strongly loaded in the inlet region by vibrations which can be further amplified by the known stabilizers. Furthermore, the boundary layer in the blade outer region, which develops at the housing wall and is thick in the case of long inflow paths, causes unfavorable inflow conditions in the blade outer region if these are not compensated by a complicated blade geometry. A further disadvantage is the high outlay on production required because of the narrow clearances required between the housing and impeller.

SUMMARY OF THE INVENTION

The invention seeks to avoid all these disadvantages. Accordingly, in the case of a compressor, one object of the invention is to widen the compressor characteristic map towards low throughput by stabilizing the flow, and at the same time to eliminate the problems of vibration and clearance in the impeller inlet region. Furthermore, in the case of the compressor with a stabilization device, another object of the invention is to reduce the boundary layer influence on the flow conditions at the blade leading edges.

This is achieved according to the invention when the stabilization device consists of a co-rotating ring rigidly connected to the runner blades, there being arranged between the ring and the housing of the compressor a recirculation duct which has an opening to the impeller at its rear end in the flow direction, only the previously customary narrow clearance existing subsequent to the rear end of this opening between impeller and wall of the housing.

The advantages of the invention are to be seen inter alia, in a widening of the compressor characteristic map towards small, but also towards large volumetric flows. At the same time, the amplitudes of the blade vibrations in the impeller inlet region are reduced, as a result of which the runner blades can be designed thinner there than previously and the efficiency of the impeller is thereby increased. A further advantage consists in that due to the large radial distance between the ring and the housing no clearance problems arise in the impeller inlet region. Moreover, the boundary layer produced on the housing inner wall in the inflow region towards the impeller no longer influences the flow conditions at the blade leading edges, since it flows past the inlet edges of the runner blades in the duct situated next to the impeller.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, in which 5 exemplary embodiments of the invention are represented with the aid of a radial compressor.

Only the elements essential for understanding the invention are shown. The flow direction of the working medium is denoted by arrows.

DESCRIPTION OF THE PREFERRED EMBODIMENTS

Figure 1:
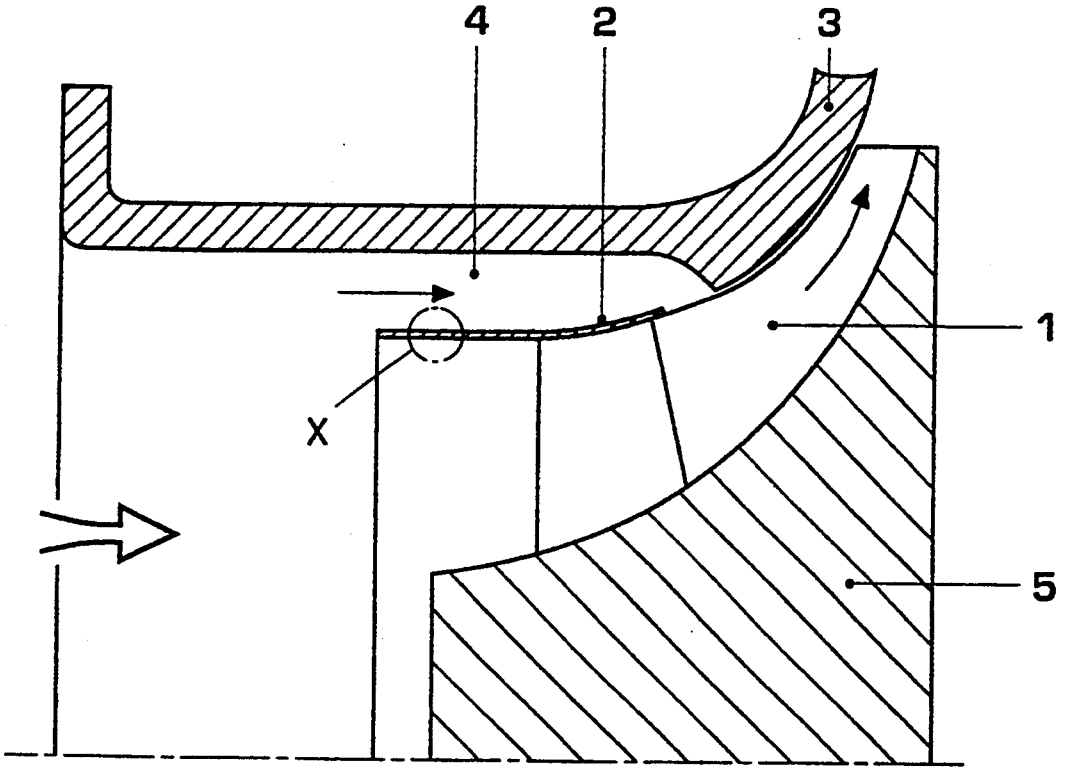
FIGS. 1 to 5 respectively show a partial meridional section of the compressor having the stabilization device.
Figure 1A:
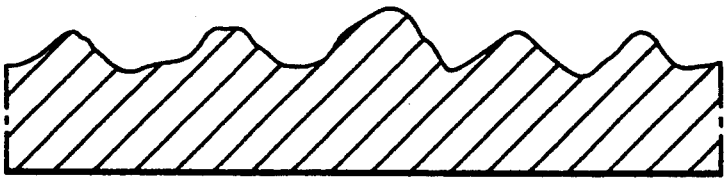

Referring now to the drawings, wherein like reference numerals designate identical or corresponding parts throughout the several views, in FIG. 1*a* part of a radial compressor having an embodiment of the stabilization device according to the invention is represented. The compressor consists of the housing 3 and the impeller 5. The impeller 5 is fitted with a co-rotating thin ring 2 which is rigidly connected to the runner blades 1. The front edge of the ring 2 in the flow direction of the gas is located in this case axially upstream of the inlet edges of the runner blades 1. Arranged between the ring 2 and the housing 3 of the compressor is a recirculation duct 4 which is bounded by the outer surface of the ring 2 and the inner surface of the compressor housing 3. The recirculation duct 4 has an opening towards the impeller 5 at its rear end in the flow direction. The impeller 5 and the inner wall of the housing 3 have the customary narrow clearance only starting from the rear end of this opening.

The ring 2 supports the blade inlet edges both in the tangential and in the radial direction. As a result, the amplitudes of the blade vibrations are sharply reduced and the mechanical blade loading drops. Because of the reduced blade loading, the runner blades 1 can be designed thinner than is possible without the ring, and this in turn effects an increase in the impeller efficiency.

The radial recirculation duct 4 situated next to the impeller 5 chiefly effects the stabilization of the compressor operational characteristic map. In the event of a restriction in the output of the compressor, the recirculation current stabilizing the flow can form through this flow duct 4. The compressor operational characteristic map is thereby widened towards small volumetric flows. On the other hand, the characteristic map is also widened towards large volumetric flows, since in the event of a very large throughput, when the speed of sound already prevails in the narrowest impeller cross-section, fluid can flow into the impeller 5 through the recirculation duct 4. The boundary layer produced in the inflow region to the impeller 5 on the outer wall of the housing 3 no longer influences the flow conditions at the leading edges of the runner blades 1, since it flows past the blade inlet edges in the recirculation duct 4 situated next to the impeller 5. There is therefore no need for a boundary layer compensation by means of a matched blade shape.

The boundary layer which forms on the co-rotating, axially projecting ring 2 rotates with the ring 2. It therefore has a swirl component which is equidirectional with the impeller rotation. As a result, the Mach number is reduced at the blade inlet edges, and this effects an improved absorption capacity of the impeller.

A further advantage of the invention consists in that due to the large distance between the ring 2 and the housing 3 clearance problems no longer occur in the impeller inlet region, and new degrees of freedom are produced there for configuring the outer contour of the impeller 5.

Figure 2:
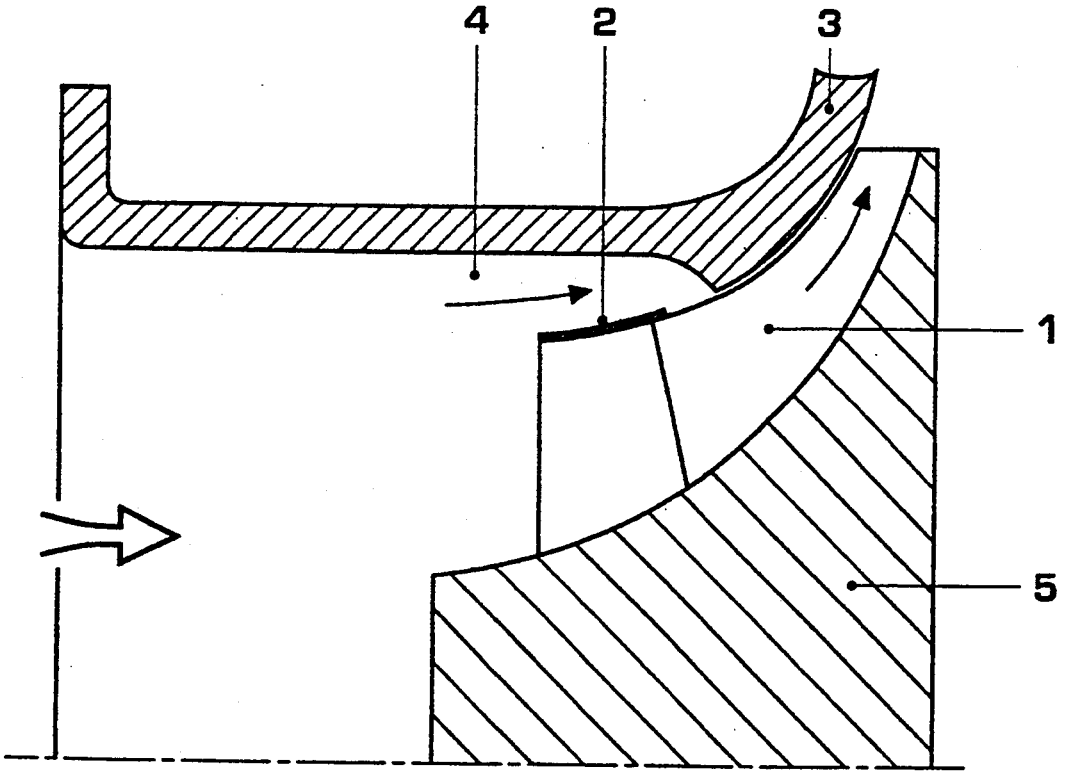
Figure 3:
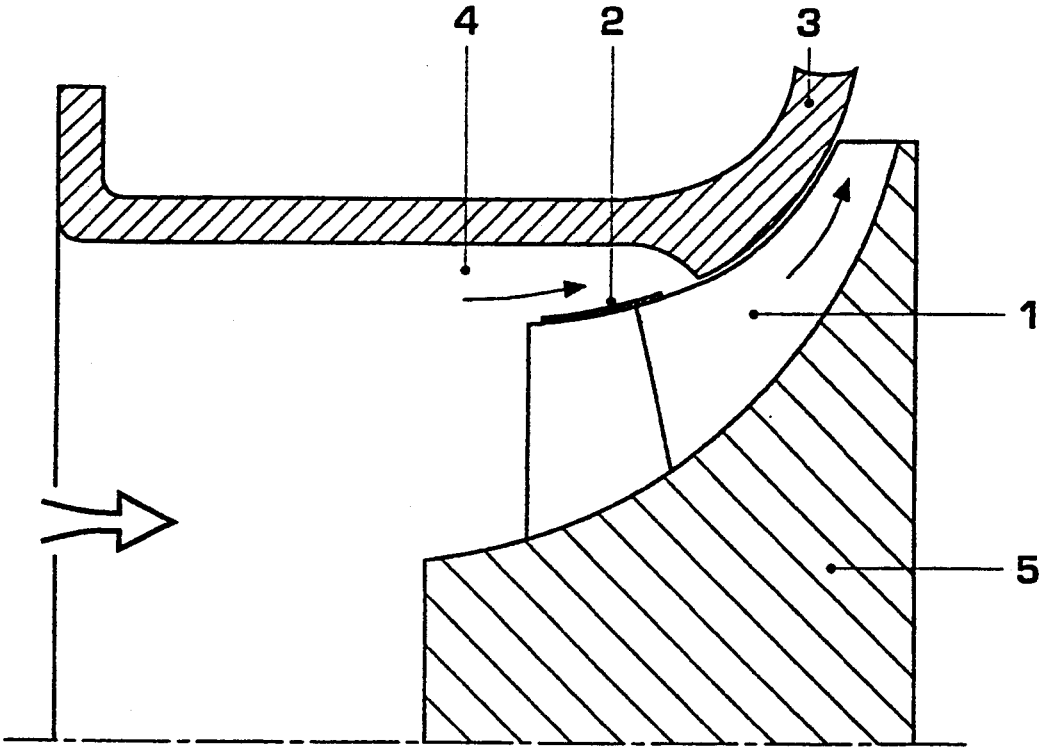
Figure 4:
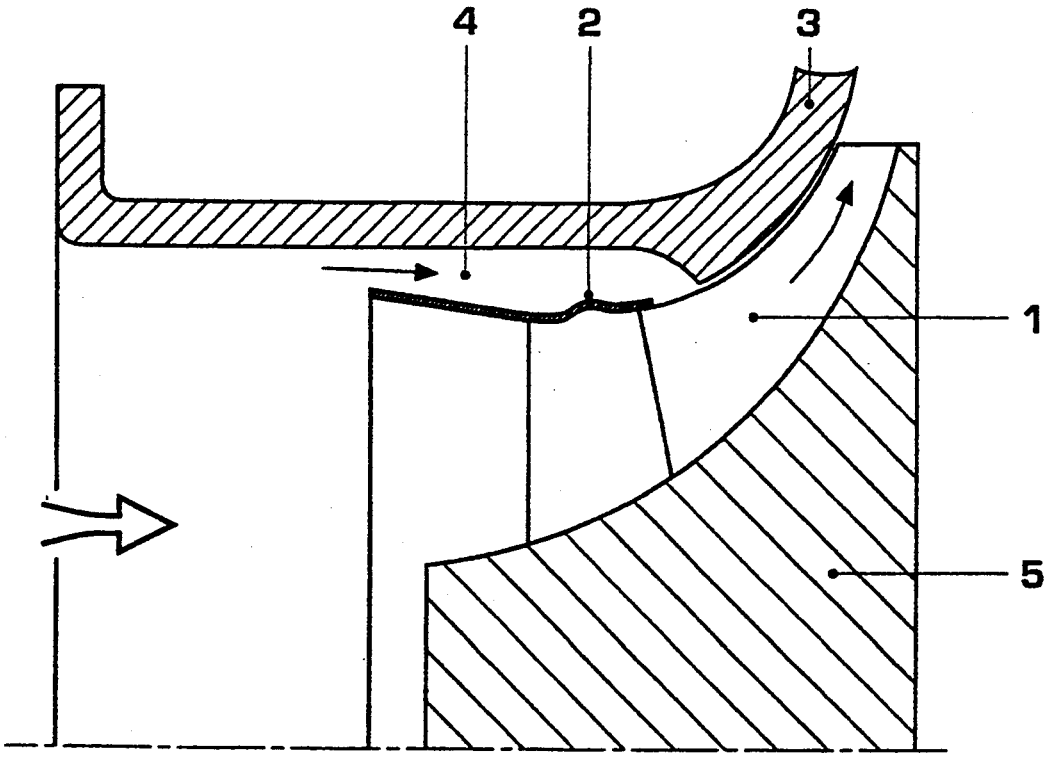

Further exemplary embodiments of the invention which relate to a different arrangement and configuration of the ring 2 are represented on a radial compressor in FIGS. 2 to 4. In FIG. 2, the ring 2, which is rigidly connected to the runner blades 1, terminates flush with the blade inlet edges, while in FIG. 3 the edge of the ring 2 which is at the front in the flow direction is located axially behind the blade inlet edges. FIG. 4 shows that the size of the radius of the ring 2 is variable in the axial direction.

It is advantageous if the surface of the ring 2 has a certain roughness, because this has a favorable influence on the swirl of the boundary layer adhering to the ring 2. FIG. 1*a*illustrates, greatly enlarge, a section of the surface of the ring indicated by the circle X in FIG. 1. The surface roughness $R_z$ should be in the range from 6.3 μm to a maximum of 40 μm, preferably around 20 μm.

Figure 5:
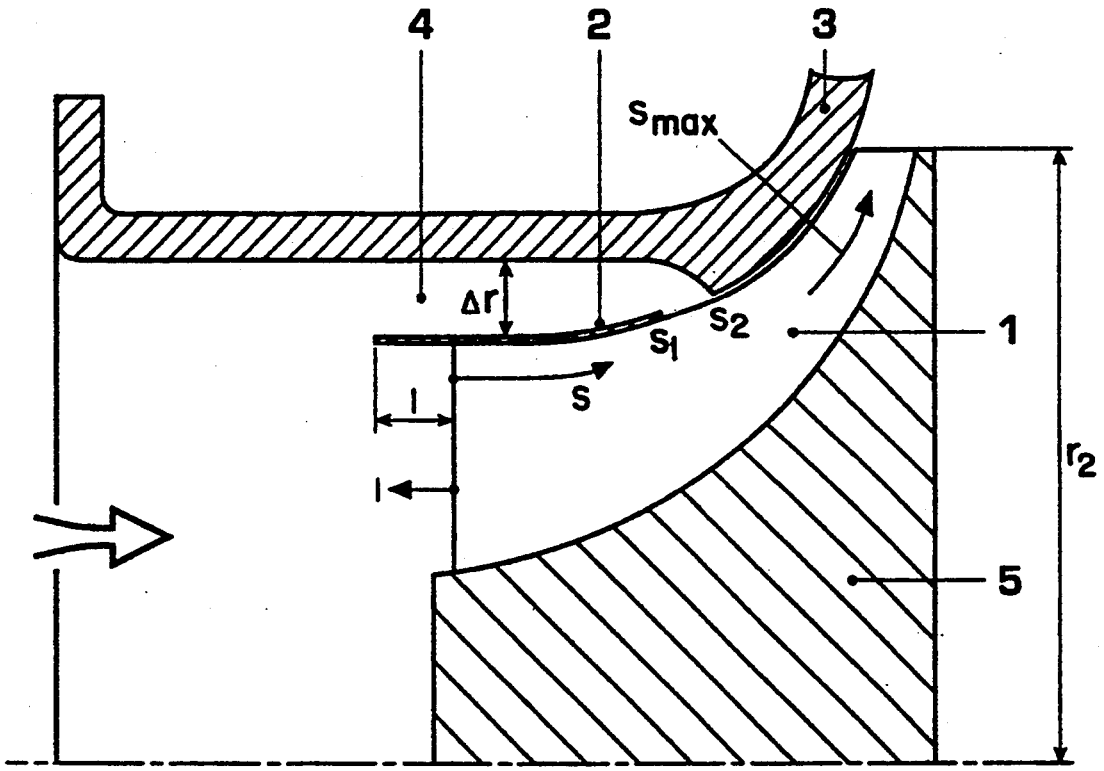

Given axial positioning of the ring 2 (FIG. 5), the dimensions of the opening of the recirculation duct 4 which is at the rear in the flow direction are in the following ranges: The ratio of the common length of the arc of the meridian between the ring and outer blade section to the length of the arc of the meridian of the outer blade section $s_1/s_{max}$ is 0.05 to a maximum of 0.2, preferably 0.09. The ratio of the length of the arc of the meridian from the blade entry edge to the end of the opening of the recirculation duct to the length of the arc of the meridian of the outer blade section $s_2/s_{max}$ is 0.15 to a maximum of 0.4, preferably 0.27, the ratio of the distance of the front edge of the ring 2 in the flow direction from the blade inlet edge to the length of the arc of the meridian of the outer blade section $1/s_{max}$ is −0.1 to a maximum of 0.6, preferably 0.41 and the ratio of the level of the re-circulation duct to the outer radius of the impeller $\Delta r/r_2$ is 0.075 to a maximum of 0.2, preferably 0.11.

The stabilization device according to the invention can, of course, also be mounted in axial compressors.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A stabilization device for extending the operational characteristic map of a compressor, comprising;

a co-rotating ring rigidly connected to the runner blades, the ring being spaced from the housing of the compressor to define a recirculation duct having an opening to the impeller at a rear end in the flow direction, the blades and the housing downstream of the opening to the impeller being spaced apart to form a clearance space narrower than the recirculation duct, wherein the radius Of the ring varies in an axial direction of the ring to vary a width of the recirculation duct.

2. The stabilization device as claimed in claim 1, wherein the front edge of the ring in the flow direction terminates flush with the inlet edges of the runner blades.

3. The stabilization device as claimed in claim 1, wherein the front edge of the ring in the flow direction is situated axially upstream of the inlet edges of the runner blades.

4. The stabilization device as claimed in claim 1, wherein the front edge of the ring in the flow direction is situated axially downstream of the inlet edges of the runner blades.

5. The stabilization device as claimed in claim 1, wherein the ring has a surface roughness $R_z$ in a range from 6.3 μm to a maximum of 40 μm.

6. The stabilization device as claimed in claim 5, wherein the surface roughness $R_z$ of the ring is 20 μm.

7. A stabilization device for extending the operational characteristic map of a compressor, comprising:

a co-rotating ring rigidly connected to the runner blades, the ring being spaced from the housing of the compressor to form a recirculation duct which has an opening to the impeller at a rear end in the flow direction, the blade and the housing downstream of the opening to the impeller being spaced apart to form a clearance space narrower than the recirculation duct, wherein given an axial position of the ring the dimensions of the flow duct are determined by a ratio of the common length of the arc of the meridian between the ring and upper blade edge ($s_1$) to the length of the arc of the meridian of the outer blade section ($s_{max}$) of 0.05 to a maximum of 0.2, a ratio of the length of the arc of the meridian from the blade inlet edge to the end of the opening of the flow duct ($s_2$) to the length of the arc of the meridian of the outer blade section ($s_{max}$) of 0.15 to a maximum of 0.4, a ratio of the distance of the front edge of the ring in the flow direction from the blade inlet edge to the length of the arc of the meridian of the outer blade section ($s_{max}$) of −0.1 to a maximum of 0.6, and a ratio of the level of the recirculation duct ($\Delta r$) to the outer radius of the impeller ($r_2$) of 0.075 to a maximum of 0.2.

8. The stabilization device as claimed in claim 7 wherein the radius of the ring is variable in the axial direction.

9. The stabilization device as claimed in claim 7, wherein the ratios $s_1/s_{max}=0.09$, $s_2/s_{max}=0.27$, $l/s_{max}=0.41$ and $\Delta r/r_2=0.11$.

* * * * *

UNITED STATES PATENT AND TRADEMARK OFFICE

CERTIFICATE OF CORRECTION

PATENT NO. : 5,403,149

DATED : April 4, 1995

INVENTOR(S) : Daniel ARNET, et al.

It is certified that error appears in the above-indentified patent and that said Letters Patent is hereby corrected as shown below:

On the title page, item:

[73] Assignee: Asea Brown Boveri Ltd., Baden, Switzerland

Signed and Sealed this

Seventh Day of November, 1995

*Attest:*

Bruce Lehman

BRUCE LEHMAN

*Attesting Officer*

*Commissioner of Patents and Trademarks*